US005375906A

United States Patent [19]

Snyder

[11] Patent Number: 5,375,906

[45] Date of Patent: Dec. 27, 1994

[54] FOLDABLE CHAIR CONSTRUCTION

[76] Inventor: Laurie Snyder, 112 A Garrison Rd., Dover, N.H. 03820

[21] Appl. No.: 20,113

[22] Filed: Feb. 19, 1993

[51] Int. Cl.[5] ..... A47C 4/00

[52] U.S. Cl. ..... 297/39; 297/452.2

[58] Field of Search ..... 297/16.1, 16.2, 17, 297/35, 39–41, 51–54, 452.2, 452.4, 378.1, 378.12

[56] References Cited

U.S. PATENT DOCUMENTS

| | | | |
|---|---|---|---|
| 1,379,285 | 5/1921 | Pewther | 297/54 |
| 4,889,383 | 12/1989 | Jones | 297/17 X |
| 5,058,950 | 10/1991 | Mann | 297/35 X |
| 5,246,265 | 9/1993 | Nagan et al. | 297/54 |

FOREIGN PATENT DOCUMENTS

| | | | |
|---|---|---|---|
| 0799406 | 6/1936 | France | 297/17 |

*Primary Examiner*—Kenneth J. Dorner
*Assistant Examiner*—Milton Nelson, Jr.
*Attorney, Agent, or Firm*—Frederick R. Cantor

[57] ABSTRACT

A foldable chair, having a seat, back, front leg structure, and a rear leg structure, hingedly connected together for folding into a compact configuration in one plane, is described. The seat, back, front leg structure, and rear leg structure, each have a U-shaped frame, that can be folded in a second plane, normal to the first plane, so that the folded chair, has compactness in two planes. Each U-shaped frame, is equipped with a cord-operated locking bolt, for holding the frame in a U-shaped configuration. The cord can be pulled, to retract the locking bolt, and slightly buckle the frame toward a folded condition.

7 Claims, 2 Drawing Sheets

FOLDABLE CHAIR CONSTRUCTION

BACKGROUND OF THE PRESENT INVENTION

The present invention, relates to foldable chairs.

The present invention, more particularly, relates to a folding chair, that is foldable in two orthogonal planes, whereby the chair has a relatively small compact condition, when in its folded state.

U.S. Pat. No. 488,095, issued to H. C. Scott and F. Schaaf, on Dec. 13, 1892, discloses a folding chair, wherein the back and the seat are formed separately from the chair legs. The chair legs are linked together by a series of foldable cross bars, such that the legs can be collapsed together into a compact bundle. The seat and back are detachably connected to the legs by means of pin-socket joints.

U.S. Pat. No. 1,341,225, issued to A. N. Clough, on May 25, 1920, discloses a collapsible chair, having a sheet of canvas, trained between a rear cross bar and a front cross bar. The cross bars are detachably connected to two upright side members. Each side member, comprises two rails, pivotably connected together in a scissors-like fashion. A foldable tie rod system interconnects the side members, so that the side members can be spaced apart, or brought together for compact storage.

U.S. Pat. No. 4,715,650 issued to Cary Bermen, on Dec. 29, 1987, discloses a collapsible lawn chair, wherein foldable transverse bars are used, to interconnect the chair side members. Each transverse bar comprises, two tubular elements, hingedly attached to the respective side members. Further, the tubular elements are hinged together at a central point, between the side members, so that the tubular elements can be folded, to lie alongside the side members. The chair construction can, thus, be folded in two planes, so as to form a relatively compact bundle for ready storage, or transport.

SUMMARY OF THE PRESENT INVENTION

An object of the present invention, is to provide a foldable chair.

Another object of the present invention, more particularly, is to provide a folding chair, that is foldable in two orthogonal planes, whereby the chair has a relatively small compact condition, when in its folded state.

The present invention, most particularly, relates to a collapsible chair that includes a back, foldable onto the upper surface of a seat, a front leg structure, foldable onto the lower surface of the seat, and a rear leg structure, folded against the folded front leg structure. Both the back and the seat, comprise tubular side members, and a flexible fabric web, extending transversely therebetween. To provide a sufficiently sturdy chair construction, the back, front leg structure, and rear leg structure, are all constructed as U-shaped frames. Each U-shaped frame, comprises two parallel side tubes, and a transverse tube assembly. Each transverse tube assembly, is defined by two hollow linear tubes, that are hingedly connected to each other, and to the parallel side tubes.

The chair can be readily unfolded to an operative condition, by pulling the side members of the chair apart, so that the transverse hollow tubes are locked together in an aligned condition. Alternately, the chair can be folded into a compact storage, or transport, mode, by causing the transverse hollow tubes to buckle around a hinge connection, located midway between the chair side members. Storage compactness is achieved, because of the fact that the chair frame elements are foldable in two orthogonal planes, i.e., a first plane, extending along the front-to-rear axis of the chair, and a second transverse plane, extending normal to the first plane.

When the chair is in its folded condition, it can be placed in a relatively small-sized storage bag, for easy transport, or storage. The storage bag, can also be equipped with a shoulder strap for easy carrying over a long distance, e.g., while hiking in a wilderness environment, etc.

A principal feature of the present invention, is a system of pull cords, that can be manually actuated, to facilitate the folding of the transverse tubes on the back, front leg means, and rear leg means. Each pull cord his oriented, so that when the cord is pulled, a locking bolt, connects two aligned hollow tubes, on a given U-shaped frame. The locking bolt, is pulled into one of the transverse hollow tubes, to produce a buckling action at the hinge connection between the two tubes. After the various pull cords have been operated, to unlock the various hinge connections, the various U-shaped frames, can be squeezed together to form a compact, folded package. The package can then be unfolded by pulling the side tubes of the U-shaped frames.

In summary, and in accordance with the above discussion, the foregoing objectives are achieved in the following embodiments.

1. A foldable chair, comprising a back, a seat, having an upper and a lower surface, a front leg, and a rear leg; a first pivot means, connecting said back to said seat, whereby said back, can be folded onto the seat upper surface; a second pivot means, connecting said front leg to said seat, whereby said front leg can be folded onto the seat lower surface; and a third pivot means, connecting said rear leg to said seat, whereby said rear leg can be folded against said folded front leg; each said back, front leg, and rear leg, comprising a U-shaped tubular construction, that includes two parallel side tubes, and a connecting transverse tube assembly; said transverse tube assembly, comprising two hollow tubes, having a hinge connection at a point equidistant from said side tubes; hinge means connecting each hollow tube to one of said side tubes, whereby said hollow tubes can be axially aligned or folded into parallelism with said side tubes; and a manually operated mechanism, for releasably holding said hollow tubes in the axially aligned condition; said mechanism, comprising a locking bolt, extendable from one of the hollow tubes into the other hollow tube, at said hinge connection; and a flexible cord operator means, accessible at one of the side tubes for retracting said locking bolt, out of said other hollow tube, whereby said hollow tubes can be rotated around said hinge connection, to assume the folded condition.

2. The foldable chair, as described in paragraph 1, wherein said cord operator means, comprises a guide pulley, within said one hollow tube, and a flexible cord, extending from said locking bolt, partially around said pulley, whereby a pulling motion on said cord, retracts said locking bolt out of said other hollow tube; said pulley, being oriented so that continued pulling motion on said cord, causes the hollow tubes to swing in opposite directions around said hinge connection.

3. The foldable chair, as described in paragraph 2, wherein said cord operator, comprises a handle, attached to said cord, remote from said locking bolt; and said handle being located on said one side tube, so that it can be pulled away from the side tube surface, to produce a pulley action on said locking bolt.

4. The foldable chair, as described in paragraph 1, and, further comprising, a spring means in said one hollow tube, in pressure engagement with said interlocking bolt, whereby said bolt, is spring-biased into the other hollow tube.

5. The foldable chair, as described in paragraph 4, and, further comprising, a stop means in said one hollow tube, said stop means being located in the path of said locking bolt, after said bolt has been retracted out of said other hollow tube, whereby said bolt is effectively locked to one said hollow tube, while said hollow tubes are swinging, in opposite directions, around said hinge connection.

6. The foldable chair, as described in paragraph 1, wherein said cord operator means comprises, a flexible cord having one end thereof attached to said locking bolt, and a handle attached to the other end of said cord; said handle being located at said one side of said side tube, so that said handle can be pulled away from the side tube surface, to retract said locking bolt; and a guide pulley within said one hollow tube, for guiding said cord; said pulley being spaced from the ends of said one hollow tube, so that when said locking bolt is in its retracted position, said pulley can move in an arc around the associated hinge means, as a response to continued pulling motion on the cord.

7. The foldable chair, as described in paragraph 1, and further comprising, a tubular storage bag; said bag being sized to accommodate the chair therein, when said chair is in its folded condition; and said bag, having a tubular side wall, and an openable zipper means, extending longitudinally along said tubular side wall, for opening said bag to said folded chair.

DESCRIPTION OF THE PREFERRED EMBODIMENTS OF THE PRESENT INVENTION

Figure 1:
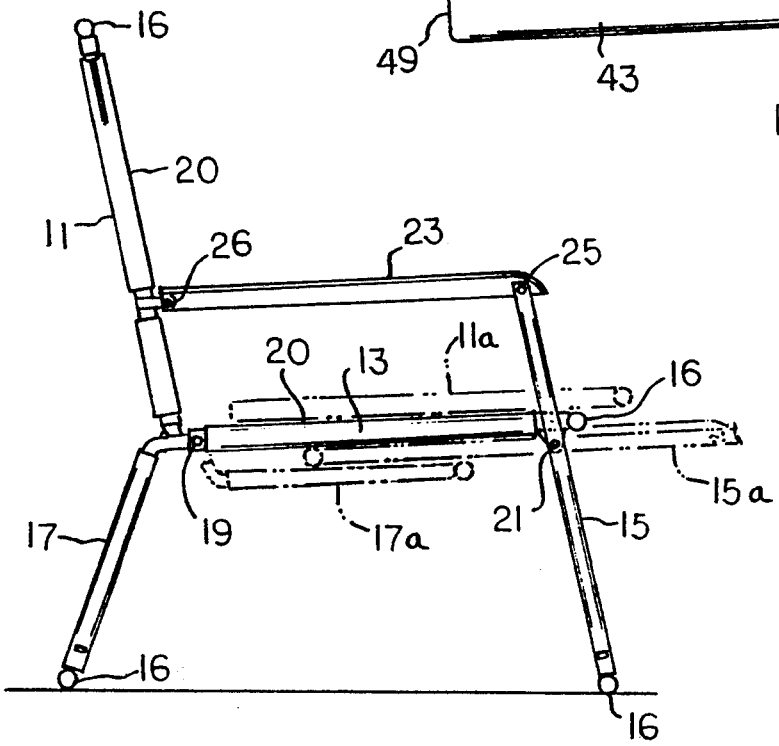
FIG. 1, is a side elevational view, of a foldable chair, being an embodiment of the present invention.

FIG. 1, is a side elevational view, of a foldable chair, being an embodiment of the present invention.

Referring to FIG. 1, there is shown a foldable chair, formed, preferably, primarily out of light-weight metal tubing, and a flexible fabric. The metal tubing, is formed into a series of U-shaped frames, in order to define a seat, a back, a rear leg means, and a front leg means. Sheets, or panels, of the fabric material, are trained between the tubular sides of the seat and back frames, to form the human support surfaces.

As seen in side elevational view, in FIG. 1, the chair comprises, a back 11, a seat 13, front leg means 15, and rear leg means 17. Back 11, seat 13, front leg means 15, and rear leg means 17, are each comprised of a U-shaped frame, formed out of interconnected metal tubes. FIG. 1, is taken in a direction, parallel to the planes of the U-shaped frames, so that only the side, or edge, areas of the frames are visible. The web, or bight, portions of the various U-shaped frames are designated by numeral 16, in FIG. 1. Each U-shaped frame comprises, two parallel side tubes, and a transverse hollow tube means 16. Only one of the side tubes for each frame is visible in FIG. 1.

The human support surfaces for back 11, and seat 13, are formed by flexible fabric panels, trained between the two side tubes, of the respective U-shaped frames. Side edge areas of the fabric panels may, at least partially, extend around the side tubes of the frames, for secure attachment of the fabric material, to the U-shaped frames. In FIG. 1, numeral 20 designates fabric material, attached to the side tubes of the U-shaped frames, that define the dimensions of back 11, and seat 13.

Each side tube of back 11, is hingedly connected to the associated side tube of the seat 13 frame, via a pivot pin 19, whereby back structure 11, can be folded forwardly onto the upper surface of the seat 13, as indicated by dashed line 11*a*, in FIG. 1.

Front leg means 15, comprises a U-shaped frame, having parallel side tubes, hingedly connected to the side tubes of seat 13, via a pivot pin means 21, whereby the front leg means 15, can be folded to a condition lying near, or against, the seat lower surface, as indicated by dashed lines 15*a*.

The upper end portions of the front leg means 15, have pivotal connections 25, with two arm rests 23. The non-illustrated arm rest 23, will be located directly behind the illustrated arm rest, shown in FIG. 1. The rear end of each arm rest 23, has pivotal connections 26, with the tubular side edge areas of back 11, such that when the seat 13, is in its folded condition, the arm rests 23, will have positions parallel to the other folded members, as shown in dashed lines. The various sets of pivot pins, 19, 21, 25, and 26, are oriented so that the frames for seat 13, back 11, front leg means 15, and arm rests 23, form a parallel bar linkage system, that can be readily folded into a relatively compact configuration, as depicted in dashed lines in FIG. 1.

Figure 2:
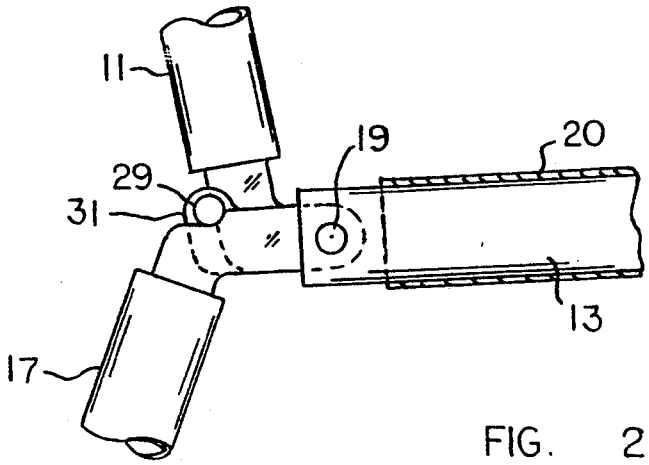
FIG. 2, is an enlarged fragmentary view, of a structural detail, used in the FIG. 1 chair.

FIG. 2, is an enlarged fragmentary view, of a structural detail, used in the FIG. 1 chair.

Rear leg means 17, has pivotal pin connections 19, with the side tubes of seat 13, whereby the rear leg means 17, can be folded to the dashed line position 17*a*, against front leg means 15, in its folded position. In the illustrated chair construction, each pivot pin 19, is used to pivotably connect seat 13, with back structure 11, and also to connect seat 13, with the rear leg means 17. However, separate pivot connections, could be used to pivotably connect the seat 13, to the back 11, and to the rear leg means 17. As seen in FIG. 2, a stop pin 29, extends laterally from a plate-like bracket arm 31, that extends rearwardly from a side tube, of the seat 13 frame. Arm 31, is located in a vertical plane, between the two plate-like arms, that extend from the side tubes of back 11, and rear leg means 17, into the associated tubular seat frame element. Stop pin 29, extends in opposite directions from plate-like arm 31, so as to serve as a stop, for both the back 11, and the rear leg means 17. The bracket construction depicted in FIG. 2, is duplicated at the non-illustrated side edge of the foldable chair. The side tubes of the seat 13 frame, can be slotted to accommodate forward pivotal motion, of the back 11, and rear leg means 17, around pivot pins 19. As previously noted, the pivotal connections between seat 13, and back 11, and rear leg means 17, can be constructed in a number of different ways, if desired.

Figure 4:
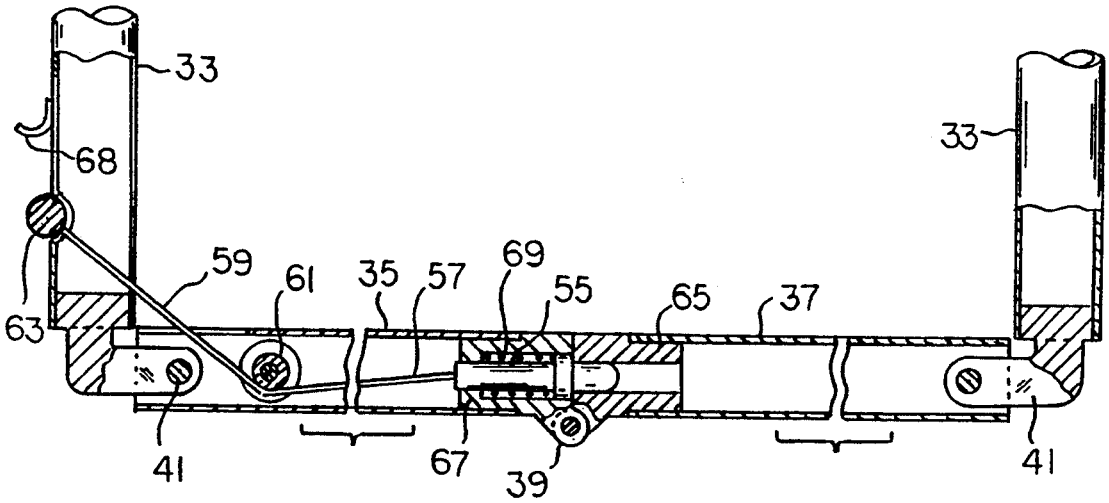
FIG. 4, is a fragmentary sectional view, of a U-shaped frame construction, that can be used in the back, seat, and leg structures of the foldable chair, shown in FIG. 1.

FIG. 4, is a fragmentary sectional view, of a U-shaped frame construction, that can be used in the back, seat, and leg structures of the foldable chair, shown in FIG. 1.

Figure 5:
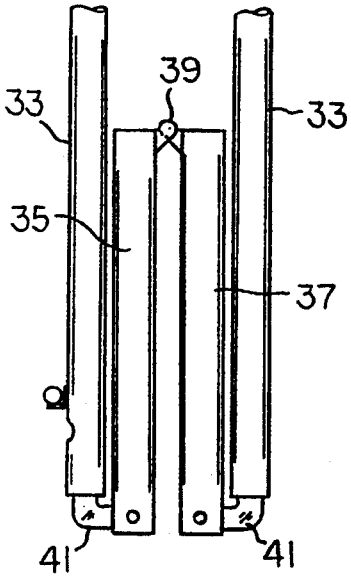
FIG. 5, is a fragmentary elevational view, of the FIG. 4 U-shaped frame construction, taken on a reduced scale, and showing the U-shaped frame construction in a folded condition.

FIG. 5, is a fragmentary elevational view, of the FIG. 4 U-shaped frame construction, taken on a reduced scale, and showing the U-shaped frame construction in a folded condition.

A principal feature of the present invention is depicted in FIGS. 4 and 5. A representative U-shaped frame is formed by two parallel side tubes 33, and a connecting transverse tube means, or assembly, 16. The transverse tube means 16, comprises two hollow tubes 35 and 37, having a hinge connection 39, located equidistant from side tubes 33. Each side tube 33, has a hinge connection 41, with one end of an associated hollow tube 35 or 37.

FIG. 4, illustrates the U-shaped frame in an operating condition, wherein transverse tubes 35 and 37, are axially aligned, to give the frame its U-shape. FIG. 5, depicts the frame in a folded condition, wherein tubes 35 and 37, are buckled around hinge connection 39, so as to be in parallelism with side tubes 33.

Figure 3:
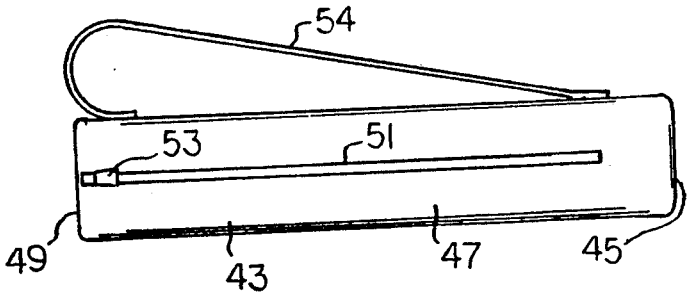
FIG. 3, is a side elevational view, of a bag, that can be used to contain the FIG. 1 chair, when the chair is in its folded condition.

FIG. 3, is a side elevational view, of a bag, that can be used to contain the FIG. 1 chair, when the chair is in its folded condition.

The U-shaped frame construction depicted in FIGS. 4 and 5, will be used for the various frames defining seat 13, back 11, front leg means 15, and rear leg means 17. When the various U-shaped frames are folded to the condition depicted in FIG. 5, the chair will have a compact dimension in two orthogonal planes, i.e., the plane of FIG. 1, and a second plane, normal to the plane of FIG. 1. The compact folded chair package, can be inserted into the bag 43, depicted in FIG. 3, for carrying or storage.

Bag 43, is comprised of a flexible fabric material, having a bottom wall 45, and a tubular side wall 47. The left end 49, of the bag, is open for insertion, and removal, of the folded chair of the present invention. To facilitate the placement of the chair of the present invention, into the bag 43, a zipper 51, may be provided along the bag side wall 47. Runner 53, of the zipper, can be pulled in a left-to-right direction, in order to open the bag side wall 47, for easy placement of the folded chair. The bag 43, can be equipped with a shoulder strap 54, whereby a person can readily carry the bag 43, and the contained chair, from place to place, e.g., when hiking in a wilderness environment, or when moving to, and from, a beach area, where the chair can be used.

The process of folding, or unfolding, the individual U-shaped frames, is complicated by the fact, that all of the various frames have to be folded, or unfolded, at the same time. Thus it is difficult to maintain frame integrity, if it is attempted to have some of the U-shaped frames in an unfolded condition, as shown in FIG. 4, while other U-shaped frames are in a folded condition, as shown in FIG. 5. To facilitate simultaneous unfolding of the various U-shaped frames, each frame includes a slidable locking bolt 55, and a flexible cord operator means 57. The illustrated flexible cord operator means 57, comprises a flexible cord 59, extending from bolt 55, within tube 35, and over, or partially around, a guide pulley 61.

Tube 35, is slotted to enable the cord to extend into side tube 33, in order to connect with a handle 63. The walls of tube 33, are slotted, so that the handle 63, can be pulled to exert a pulling action on cord 59, whereby locking bolt 55, can be retracted out of an opening in an end fitting 65, of tube 37. In its illustrated position, the slidable locking bolt, spans two end fittings 65 and 67, carried by hollow tubes 35 and 37, whereby the tubes are locked together in an axially aligned condition. When bolt 55, is retracted out of end fitting 65, the two tubes 35 and 37, are in a condition whereby they can buckle around the central hinge connection 39.

As handle 63, is pulled from its FIG. 4 position, the locking bolt 55, compresses a coil spring 69, located within end fitting 67. When the spring coils bottom against each other, the locking bolt 55, becomes a fixed part of tube 35. Continued pulling on handle 63, causes the cord to exert a pulling force on pulley 61, such that the pulley begins to move in an arc, around the axis of hinge 41. Tubes 35 and 37, thus begin to buckle from the FIG. 4 position, to the FIG. 5 folded position.

Handle 63, can be placed in a holder 68, with the two tubes 35 and 37, slightly buckled, i.e., with the two tubes angled slightly angled upwardly in an inverted V-configuration, when viewed in FIG. 4. To achieve a folded condition, the chair may be folded in a front-to-rear plane, whereby the various U-shaped frames are positioned against one another, as depicted in the dashed lines in FIG. 1. Then, the various handles 63, for all of the U-shaped frames, can be pulled sufficient amounts, so as to cause the bolt 55, to be located within the various holders 68.

With all of the U-shaped frames unlocked, and slightly buckled, the side tubes of the frames can be brought toward each other, so that each frame is in the FIG. 5, folded condition. The chair is, thus, in a compact condition, folded in two orthogonal planes, whereby the folded chair, can then be readily inserted into bag 43.

To unfold the chair, the various handles 63, can be relocated to the position shown in FIG. 4. Then the side tubes of the various frames can be pulled apart, so that hollow tubes 35 and 37, move toward the FIG. 4 condition. As the FIG. 4 condition is approached, the locking bolt 55, automatically snaps into the hole in end fitting 65. Spring 69, acts as the propelling force to move locking bolt 55, to the locked condition, as depicted in FIG. 4.

As above-noted, the locking bolt 55, and cord-operated actuator means 57, depicted in FIG. 4, constitute a principal feature of this invention. Some variations in the manner of constructing the cord-locking bolt assembly, can be made, while still practicing this invention. A principal advantage of the structure, is that the various U-shaped frames can all be in slightly buckled conditions, while the chair is being folded, or unfolded, in a plane transverse to the FIG. 1 plane. The transverse folding, or unfolding, action, can be carried out without any one of the U-shaped frames from interfering with the movement of the other frames.

The present invention describes a foldable chair construction. Features of the present invention are recited in the appended claims. The drawings contained herein necessarily depict structural features and embodiments of the foldable chair construction, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical, and functional equivalents to the above, which may be obvious to those skilled in the arts pertaining thereto, are considered to be encompassed within the claims of the present invention.

What is claimed is:

1. A foldable chair, comprising a back, a seat having an upper and a lower surface, a front leg, and a rear leg; a first pivot means connecting said back to said seat, whereby said back can be folded onto the seat upper surface; a second pivot means, connecting said front leg to said seat, whereby said front leg can be folded onto the seat lower surface; and a third pivot means, connecting said rear leg to said seat, whereby said rear leg can be folded against said folded front leg; each said back, front leg, and rear leg, comprising a U-shaped tubular construct/on, that includes two parallel side tubes, and a connecting transverse tube assembly; each said transverse tube assembly, comprising two hollow tubes, having a hinge connection at a point equidistant from said side tubes; hinge means connecting each hollow tube to one of said side tubes, whereby said hollow tubes can be axially aligned or folded into parallelism with said side tubes; and a manually operated mechanism for releasably holding said hollow tubes in the axially aligned condition; said mechanism, comprising a locking bolt extendable from one of the hollow tubes into the other hollow tube, at said hinge connection; and a flexible cord operator means, accessible at one of the side tubes for retracting said locking bolt, out of said other hollow tube, whereby said hollow tubes can be rotated around said hinge connection, to assume the folded condition.

2. The foldable chair, as described in claim 1, wherein said cord operator means comprises, a flexible cord having one end thereof attached to said locking bolt, and a handle attached to the other end of said cord; said handle being located at said one side of said side tube, so that said handle can be pulled away from the side tube surface, to retract said locking bolt; and a guide pulley within said one hollow tube, for guiding said cord; said pulley being spaced from the ends of said one hollow tube, so that when said locking bolt is in its retracted position, said pulley can move in an arc around the associated hinge means, as a response to continued pulling motion on the cord.

3. The foldable chair, as described in claim 1, and further comprising, a tubular storage bag; said bag being sized to accommodate the chair therein, when said chair is in its folded condition; and said bag, having a tubular side wall, and an openable zipper means, extending longitudinally along said tubular side wall, for opening said bag to said folded chair.

4. The foldable chair, as described in claim i, wherein said cord operator means, comprises a guide pulley, within said one hollow tube, and a flexible cord, extending from said locking bolt, partially around said pulley, whereby a pulling motion on said cord, retracts said locking bolt out of said other hollow tube; said pulley, being oriented so that continued pulling motion on said cord, causes the hollow tubes to swing in opposite directions around said hinge connection.

5. The foldable chair, as described in claim 4, wherein said cord operator means comprises a handle, attached to said cord, remote from said locking bolt; and said handle being located on said one side tube, so that said handle can be pulled away from the side tube surface, to produce a pulley action on said locking bolt.

6. The foldable chair, as described in claim 1, and, further comprising, a spring means in said one hollow tube, in pressure engagement with said locking bolt, whereby said bolt, is spring-biased into the other hollow tube.

7. The foldable chair, as described in claim 6, and, further comprising, a stop means in said one hollow tube, said stop means being located in the path of said locking bolt after said bolt has been retracted out of said other hollow tube, whereby said bolt is effectively locked to one said hollow tube, while said hollow tubes are swinging, in opposite directions, around said hinge connection.

* * * * *